United States Patent [19]

Kinouchi et al.

[11] Patent Number: 4,793,773

[45] Date of Patent: Dec. 27, 1988

[54] MARINE PROPELLING APPARATUS

[75] Inventors: Sosuke Kinouchi, Kakogawa; Hideto Yoshitake, Akashi, both of Japan

[73] Assignee: Kawasaki Jukogyo Kabushiki Kaisha, Kobe, Japan

[21] Appl. No.: 110,203

[22] Filed: Oct. 19, 1987

[30] Foreign Application Priority Data

Oct. 20, 1986 [JP] Japan ..... 61-250026

[51] Int. Cl.[4] ..... B63H 5/10

[52] U.S. Cl. ..... 416/129; 416/170 R; 416/169 R; 416/93 A; 415/68

[58] Field of Search ..... 416/129 A, 130, 169 C, 416/124, 128, 170 R, 93 A; 415/61, 68

[56] References Cited

U.S. PATENT DOCUMENTS

| | | | |
|---|---|---|---|
| 2,672,115 | 3/1954 | Conover | 416/129 A X |
| 2,989,022 | 6/1961 | Lundquist | 416/129 A |
| 3,478,620 | 11/1969 | Shimanckas | 416/129 A X |
| 4,540,369 | 9/1985 | Caires | 416/129 A X |

FOREIGN PATENT DOCUMENTS

| | | | |
|---|---|---|---|
| 59-70292 | 4/1984 | Japan . | |
| 59-84693 | 5/1984 | Japan . | |
| 259594 | 12/1985 | Japan | 416/134 R |
| 61-13437 | 4/1986 | Japan . | |

*Primary Examiner*—Everette A. Powell, Jr.

*Attorney, Agent, or Firm*—Marshall, O'Toole, Gerstein, Murray & Bicknell

[57] ABSTRACT

This disclosure relates to a marine propulsion system including a double propeller. To obtain a forward thrust, the two propellers are driven in opposite directions while producing forward propulsion forces. To obtain a rearward thrust, only one propeller is driven in the direction to produce a rearward force. The two propellers are attached to coaxial inner and outer horizontal shafts. A single vertical shaft is coupled by bevel gears to the shafts, and movable clutches couple the driving force to the horizontal shafts.

4 Claims, 2 Drawing Sheets

MARINE PROPELLING APPARATUS

FIELD AND BACKGROUND OF THE INVENTION

The present invention relates to a marine propulsion apparatus having a double-propeller construction, and more specifically having a pair of propellers which can be driven in rotation in the opposite directions to both exert a forward thrust.

Apparatus of this general type is shown in FIG. 6 of U.S. Pat. No. 2,989,022 issued on June 20, 1961 and Japanese Patent Provisional Publication 60-259594 laid open on Dec. 21, 1985, for example. Such prior art apparatus requires two vertical driving shafts and means for dividing the driving power between the shafts. This increases the horizontal length and the weight of the apparatus, thereby lowering the propulsive efficiency.

In addition, with reference to FIG. 3 of the present application, which shows a part of the structure of the Japanese publication with a modification in accordance with the present invention, an oil seal 70 is provided directly between the inner and outer propeller shafts 5 and 7. The thickness of this seal increases the diameter of the outer shaft 7, resulting in an increased diameter of the propeller surrounding the outer shaft.

It is a general object of the invention to provide a compact and lightweight marine propelling apparatus having a pair of propellers.

SUMMARY OF THE INVENTION

An apparatus according to the first aspect of this invention comprises:

a housing having a front end and a rear end, a single vertical shaft journalled in said housing and adapted to be driven to rotate in one direction, a driving bevel gear secured to the lower end of said vertical shaft, a pair of first and second oppositely driven bevel gears journalled in said housing on a horizontal axis, said first gear being located forwardly from said second gear, said driven gears being in driving mesh with said driving gear to rotate in opposite directions, and having axially inner teeth on their adjacent sides, said second driven gear being located rearwardly from said first gear and having axially outer teeth at its rear end, an outer hollow horizontal shaft journalled in said housing on said axis, an inner horizontal shaft journalled coaxially inside said outer shaft and extending rotatably through said driven gears, a first propeller for rotation in opposite directions to exert forward and rearward drive thrusts, said propeller being carried by said inner shaft adjacent said rear end, a second propeller for rotation in one direction to exert a forward drive thrust, said second propeller being carried by said outer shaft forwardly adjacent said first propeller, a first annular clutch supported around said inner horizontal shaft between said driven gears in axially slidable and rotationally driving engagement with said inner shaft, said first clutch having teeth at both ends for alternative meshing with said inner teeth of one of said driven gears, a second annular clutch supported around said outer horizontal shaft rearwardly adjacent said second driven gear in axially slidable and rotationally driving engagement with said outer shaft, said second clutch having teeth at its front end for meshing with said outer teeth of said second gear, and slide means connected to said clutches to slide them together between three axially different positions, one of said positions being a forward drive position wherein said first clutch meshes with said first driven gear while said second clutch meshes with said second gear, another being a neutral position wherein said clutches disengage from said driven gears, and the third being a rearward drive position wherein said first clutch meshes with said second gear while said second clutch disengages from said second gear.

An apparatus according to the second aspect of the invention comprises:

a housing having a front end and a rear end, an outer hollow propeller shaft journalled in said housing on a horizontal axis extending through said ends, an inner propeller shaft journalled coaxially inside said outer shaft, a first propeller for rotation in opposite directions to exert forward and rearward drive thrusts, said propeller being carried by said inner shaft adjacent said rear end, a second propeller for rotation in one direction to exert a forward drive thrust, said second propeller being carried by said outer shaft forwardly adjacent said first propeller, first and second annular damper means surrounding said inner and outer shafts, respectively, and frictionally coupling them to said first and second propellers, respectively, said first damper means being spaced rearwardly from said second means, a first annular retainer mounted around said inner shaft axially between said first and second damper means and adjacent the rear end of said outer shaft, a first fastener mounted around said inner shaft rearwardly from said first damper means, and cooperating with said first retainer to axially fix said first propeller to said inner shaft, a second annular retainer mounted around said outer shaft forwardly from said second damper means, a second fastener mounted around said outer shaft axially between said second damper means and said first retainer, and cooperating with said second retainer to axially fix said second propeller to said outer shaft, said first retainer surrounding the rear end of said outer shaft, a first seal provided between said first retainer and outer shaft, and a second seal provided between said first retainer and inner shaft.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Although the invention is described herein as applied to a marine outboard engine, it should be understood that it is not limited to outboard engines but could also be applied to inboard engines, etc.

Figure 1:
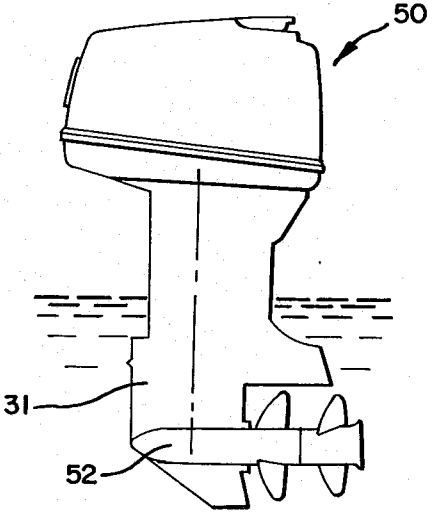
FIG. 1 is an overall view of an engine including apparatus embodying the invention.

With reference to FIG. 1, a marine outboard engine generally indicated by the numeral 50, embodying the invention has a propelling apparatus 52 at its lower end. The engine 50 is designed to be mounted on the aft end of a conventional small boat (not shown) with the lower end of the engine housing 31 and the apparatus 52 extending into the water 51.

Figure 2:
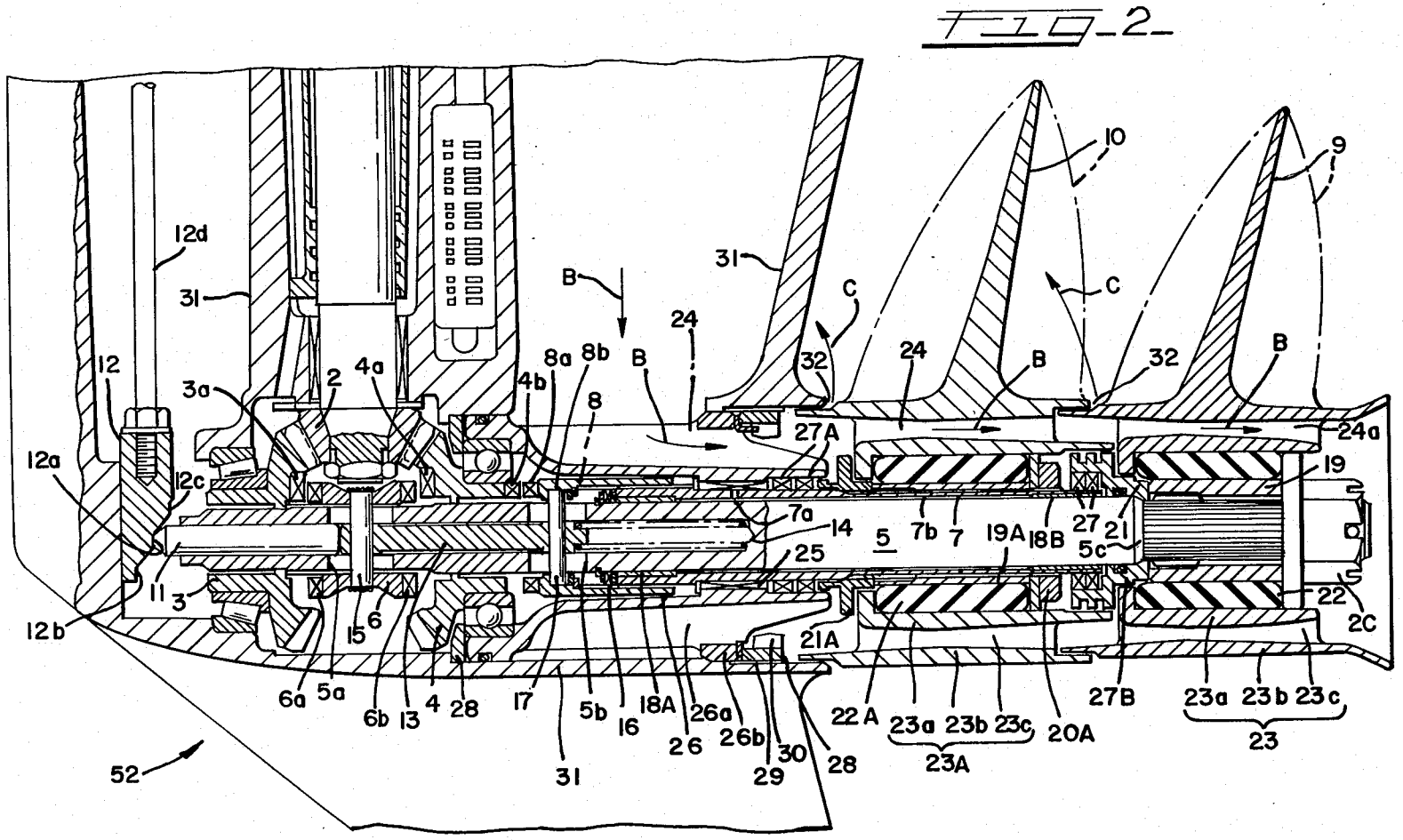
FIG. 2 is a fragmentary side view in axial section of a portion of the engine of FIG. 1, showing the apparatus adapted for use as part of a marine outboard engine.

The apparatus 52 is shown in FIG. 2 in its neutral position, and it includes the main housing 31. A funnel-shaped bearing housing 26 extends on a horizontal axis (when mounted for normal operation), and has its front end secured to the housing 31 by a front end ring 28 an anti-rotation washer 29 and a nut 30. The bearing housing 26 rotatably supports an outer hollow horizontal shaft 7 thereinside by means of a needle bearing 25.

The bearing housing 26 has radially and axially extending ribs 26*a*, which mate with a ring 26*b* formed therearound. The ribs 26*a* define passages 24 for the engine exhaust gas.

A vertical power output shaft 1 is journalled in the main housing 31 and driven by an engine (not shown) in the upper part of the housing, the shaft 1 rotating clockwise as seen from its upper end.

The lower end of the vertical shaft 1 has secured thereto a driving bevel gear 2 which is in driving mesh with a pair of cooperating bevel gears 3 and 4, which are on opposite sides of the driving gear 2 and are journalled in the main housing 31 so that they rotate on the horizontal axis but in opposite directions. The driven gears 3 and 4 have axially inner teeth 3*a* and 4*a*, respectively, on their adjacent sides. The rearwardly located gear 4 also has axially outer teeth 4*b* at its rear end.

The driven gears 3 and 4 coaxially journal a first or inner horizontal propeller shaft 5, which has a forward hollow portion adjacent the gears and a rear solid portion. The shaft 5 is also journalled inside the outer horizontal shaft 7 through a thrust roller bearing 16 and a pair of plain sleeve bearing bushes 18A and 18B.

The hollow portion of the inner shaft 5 supports a cam shaft 11 axially slidable therethrough, the forward end of which projects from the inner shaft 5 and engages a sloped cam 12. This cam can be manually vertically reciprocated by moving a cam rod 12*d*, and the cam has three vertical surfaces 12*a*–*c* staggered axially of the horizontal shafts.

The rear end of the cam shaft 11 faces the forward end of a slide shaft 13, which axially extends through the inner shaft 5 in axially slidable and rotationally driving engagement therewith by a splined connection. The rear end of the slide shaft 13 engages a compression spring 14 mounted within the inner shaft 5, to urge the slide shaft 13 forwardly and urge the cam shaft 11 relative to the inner shaft 5 against the sloped cam 12.

The hollow portion of the inner shaft 5 has two axially spaced pairs 5*a* and 5*b* of axially extending slots formed therethrough from its outer surface to the interior opening. The front slot pair 5*a* is located between the driven gears 3 and 4, while the rear slot pair 5*b* is located rearwardly adjacent the rear gear 4.

The slide shaft 13 has secured thereto a pair of radial pins 15 and 17. These pins extend through the slot pairs 5*a* and 5*b*, respectively, in axially slidable and rotationally driving engagement therewith. The front pin 15 is fixed at its outer ends to a first clutch sleeve 6.

The clutch sleeve 6 is in axially slidable and rotationally driving engagement by a splined connection with the outer periphery of the inner shaft 5. The clutch 6 has teeth 6*a* and 6*b* at both axial ends for alternative driving engagement with the teeth 3*a* or 4*a* of the driven gear 3 or 4, in order to rotate the inner shaft 5 in one direction or the other.

The rear radial pin 17 slidably engages an inner annular groove 8*b* formed in the inner wall of a second clutch sleeve 8, so that the pin 17 can rotate with the inner shaft 5 relative to the sleeve 8 and move with the sleeve axially thereof.

The inner wall of a rear portion of this sleeve 8 is in axially slidable and rotationally driving engagement by a splined connection with the outer wall of a forward portion of the outer shaft 7.

The sleeve 8 has teeth 8*a* at its front end for driving mesh with the outer teeth 4*b* of the rear gear 4, to transmit the rotational force of only this gear 4 to the outer shaft 7 for rotation in one direction.

The inner shaft 5 has a rear end portion of a reduced diameter, which extends rearwardly from the outer shaft 7 and is connected to the remaining portion by a conical portion 5*c* of the shaft 5. This shaft end portion carries a first outer sleeve 19 in driving engagement therearound by a splined connection. The sleeve 19 is fixed to the shaft 5 between a first nut 20 threaded on the rear end of the shaft 5 and a first annular retainer 21 in engagement with the conical portion 5*c*.

The sleeve 19 is surrounded by a first annular rubber damper 22 secured thereto as by a heat process. The damper 22 is surrounded by the boss 23 of a first or rear propeller 9, and held under pressure between the boss and the sleeve 19 in frictional engagement with the boss 23 to transmit a rotational force from the sleeve 19 to the propeller 9.

The rear propeller 9 is adapted to exert a forward drive thrust when rotated clockwise as viewed from the rear.

The propeller boss 23 has an inner sleeve 23*a*, an outer sleeve 23*b* formed with propeller blades, and ribs 23*c* bridging these sleeves and defining axially extending passages 24*a* therebetween, which communicate with the passages 24 of the bearing housing 26.

The outer shaft 7 carries adjacent its rear end a second or front propeller 10, which is located forwardly and adjacent the rear propeller 9. The front propeller 10 is also adapted to exert a forward drive thrust when rotated counterclockwise as viewed from the rear.

The front propeller 10 has a boss 23A of substantially the same construction as the rear propeller boss 23. The propeller 10 is in driving engagement around the outer shaft 7 through a second set of a sleeve 19A, a damper 22A, a nut 20A, a retainer 21A and a conical portion of the shaft 7, which are similar to the set for the rear propeller 9.

The propeller bosses 23 and 23A are axially held by the retainers 23 and 23A, dampers 22 and 22A and nuts 20 and 20A, respectively. These bosses are enabled to smoothly rotate because of clearances 32 between their outer sleeves **23*b* and between the outer sleeve 23*b* of the front propeller 10 and the housing 31**.

The outer shaft 7 has a radial oil passage **7*a* formed therethrough for lubrication of the engaging surfaces 7*b* of the shafts 5 and 7. A pair of oil seals 27A are interposed between the outer shaft 7 and the bearing housing 26**.

Interposed between the rear end of the outer shaft 7 and the first retainer 21 are a pair of first seals (oil seals) 27. Interposed between the inner shaft 5 and the first retainer 21 is a second seal (an O-ring) 27B.

The first retainer 21 is located rearwardly from the second nut 20A, and extends over the rear end of the outer shaft 7 and closely over the conical portion **5*c* of the inner shaft 5 into the inner sleeve 23*a* of the second propeller boss 23A**.

For the forward drive, the sloped cam 12 is raised or moved up by an inner push-pull cable (not shown) attached to the rod **12*d*, so that the cam shaft 11, presently shown as engaging the neutral cam surface 12*a*, is forced to engage the forward cam surface 12*b*, the spring 14 pushing the slide shaft 13 forwardly. This forwardly slides the radial pins 15 and 17 along the slots 5*a* and 5*b*, so that the first clutch 6 meshes with the front driven gear 3, and the second clutch 8 meshes with the rear gear 4**.

The clockwise rotation of the vertical shaft 1 rotates the forward gear 3 clockwise as seen from the rear, thereby rotating the first propeller 9 clockwise through the clutch 6, shaft 5, sleeve 19 and damper 22.

On the other hand, the rear gear 4 rotates counterclockwise, rotating the second propeller 10 counterclockwise at the same speed as the first propeller 9 through the clutch 8, shaft 7, sleeve 19A and damper 22A.

Thus, for the forward drive, the apparatus functions as a double propeller to obtain an improved propulsive efficiency.

For the rearward drive, the sloped cam 12 is lowered so that the cam shaft 11 engages the rear cam surface **12*c*. This rearwardly slides the first clutch 6 against the force of the spring 14 into mesh with the rear gear 4. The counterclockwise rotation of this gear 4 likewise rotates the first propeller 9** now counterclockwise.

On the other hand, the rearward movement of the cam shaft 13 disengages the second clutch 8 from the rear gear 4, so that the second propeller 10 does not rotate. Because the rearward drive does not require a large thrust, the first propeller 9 by itself can produce a sufficient rearward thrust.

Figure 3:
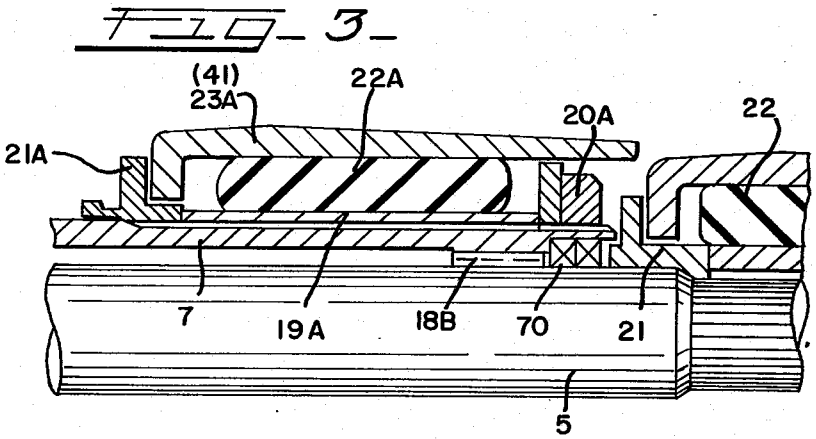
FIG. 3 is a fragmentary side view in axial section of part of a prior art construction modified in accordance with the present invention.

As shown in FIG. 2, the seals 27 and 27B between the propeller shafts 5 and 7 are located rearwardly from the second thick damper 22A, substantially without being radially displaced from it as is the case with the comparative example in FIG. 3.

This reduces the diameters of not only the outer shaft 7 but the second propeller 10 as a whole, thus reducing the size of the apparatus and improving the propulsive efficiency. This is particularly advantageous for the present embodiment wherein the propeller hubs 23 and 23A have the gas passages 24 and **24*a*** therethrough.

As compared with the arrangement in FIG. 3, what is additionally required in FIG. 2 by the sealing arrangement between the shafts 5 and 7 is only the seal 27B, which is less likely to hinder the production of the apparatus.

The engine exhaust gas is discharged rearwardly through the passages 24 and **24*a*** as shown by the arrows B and out of the apparatus.

When the boat is moving rearwardly, the thrust applies a water pressure into the passages 24 and **24*a*, so that a large amount of gas spouts from these passages through the clearances 32 as indicated by the arrows C. Because the rearward thrust is produced by the first propeller 9 rearward from the clearances 32**, it is not possible that the spout will lower the rearward thrust.

Figure 4:
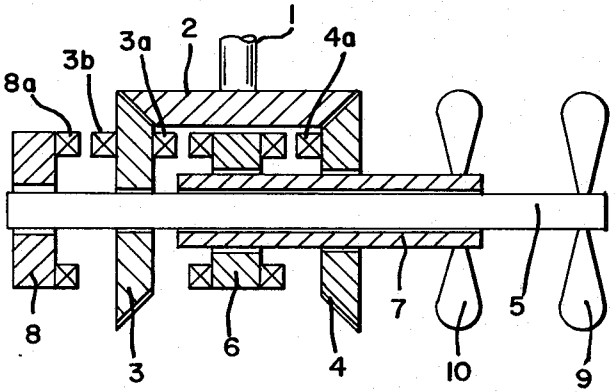
FIG. 4 is a schematic view showing an alternative embodiment of the invention.

FIG. 4 shows another embodiment of the invention, wherein a front driven bevel gear 3 has front end teeth **3*b*. The front end of an inner propeller shaft 5 is in engagement by splines with a clutch sleeve 8, which is located forwardly from the front gear 3 for meshing engagement with it. The front end of an outer propeller shaft 7 extends rotatably through a rear driven bevel gear 4 into engagement by splines with a clutch sleeve 6 for meshing engagement with one of the gears 3 and 4**.

The outer shaft 7 carries a propeller 10 for rotation in opposite directions to exert forward or rearward thrusts. The inner shaft 5 carries a propeller 9 for rotation in one direction to exert a forward thrust.

The other parts and functions are similar to those of the first embodiment, and the corresponding parts are given the same numerals and require no further description.

What is claimed is:

1. A marine propelling apparatus comprising:

a housing having a front end and a rear end, a single vertical shaft rotatably journalled in said housing and adapted to be driven to rotate in one direction, a driving bevel gear secured to the lower end of said vertical shaft, a pair of first and second oppositely driven bevel gears journalled in said housing on a horizontal axis, said first gear being located forwardly from said second gear, said driven bevel gears being in driving mesh with said driving gear to rotate in opposite directions, and having axially inner teeth on their adjacent sides, said second driven bevel gear being located rearwardly from said first driven bevel gear and having axially outer teeth at its rear end, an outer hollow horizontal shaft journalled in said housing on said axis, an inner horizontal shaft journalled coaxially inside said outer shaft and extending rotatably through said driven bevel gears, a first propeller for rotation in opposite directions to exert forward and rearward drive thrusts, said first propeller being carried by said inner shaft adjacent said rear end, a second propeller for rotation in one direction to exert a forward drive thrust, said second propeller being carried by said outer shaft forwardly adjacent said first propeller, a first annular clutch supported around said inner horizontal shaft between said driven bevel gears in axially slidable and rotationally driving engagement with said inner shaft, said first annular clutch having teeth at both ends for alternative meshing with said inner teeth of one of said driven gears, a second annular clutch supported around said outer horizontal shaft rearwardly adjacent said second driven bevel gear in axially slidable and rotationally driving engagement with said outer shaft, said second annular clutch having teeth at its front end for meshing with said outer teeth of said second driven bevel gear, and slide means connected to said clutches to slide them together between first and second axially different positions, said first position being a forward drive position wherein said first annular clutch meshes with said first driven bevel gear while said second annular clutch meshes with said second driven bevel gear, whereby said first and second propellers are driven through separate driven bevel gears and both propellers exert forward drive thrust and said second position being a rearward drive position wherein said first annular clutch meshes with said second bevel gear while said second annular clutch disengages from said second bevel gear, whereby only said first propeller is driven and exerts rearward drive thrust.

2. An apparatus as set forth in claim 1, wherein said inner shaft has a hollow portion adjacent said front end, said hollow portion having first and second slots axially extending therethrough, said first slots being located forwardly from said second slots, said slide means comprising:

a first radially extending pin extending slidably through said first slots and fixed to said first clutch, a second radially extending pin extending slidably through said second slots and axially fixed to said second clutch, but rotatable relative to said second clutch on said axis, and a slide shaft fixed to said pins and extending axially slidably through said hollow portion of said inner shaft.

3. A marine propelling apparatus comprising:

a housing having a front end and a rear end, an outer hollow propeller shaft journalled in said housing on a horizontal axis extending through said ends, an inner propeller shaft journalled coaxially inside said outer shaft, a first propeller for rotation in opposite directions to exert forward and rearward drive thrusts, said propeller being carried by said inner shaft adjacent said rear end, a second propeller for rotation in one direction to exert a forward drive thrust, said second propeller being carried by said outer shaft forwardly adjacent said first propeller, a single gear drive means connectable to said inner shaft and to said outer shaft for driving both of said shafts and said propellers in opposite directions to produce forward drive thrust and connectable only to said outer shaft and said second propeller for driving said second propeller in a direction to produce rearward drive thrust, first and second annular damper means surrounding said inner and outer shafts, respectively, and frictionally coupling them to said first and second propellers, respectively, said first damper means being spaced rearwardly from said second means, a first annular retainer mounted around said inner shaft axially between said first and second damper means and adjacent the rear end of said outer shaft, a first fastener mounted around said inner shaft rearwardly from said first damper means, and cooperating with said first retainer to axially fix said first propeller to said inner shaft, a second annular retainer mounted around said outer shaft forwardly from said second damper means, a second fastener mounted around said outer shaft axially between said second damper means and said first retainer, and cooperating with said second retainer to axially fix said second propeller to said outer shaft, said first retainer surrounding the rear end of said outer shaft, a first seal provided between said first retainer and said outer shaft, and a second seal provided between said first retainer and said inner shaft.

4. An apparatus as set forth in claim 1, wherein said slide means is further connected to said clutches to slide them to a third position, said third position being a neutral position wherein said clutches disengage from said driven gears.

* * * * *